US012103757B2

(12) United States Patent
Raker

(10) Patent No.: US 12,103,757 B2
(45) Date of Patent: Oct. 1, 2024

(54) PLUSH TOY PARCEL SUITABLE FOR SHIPPING

(71) Applicant: Cheyenne Marie Raker, Greenville, SC (US)

(72) Inventor: Cheyenne Marie Raker, Greenville, SC (US)

( * ) Notice: Subject to any disclaimer, the term of this patent is extended or adjusted under 35 U.S.C. 154(b) by 84 days.

(21) Appl. No.: 17/876,687

(22) Filed: Jul. 29, 2022

(65) Prior Publication Data

US 2023/0045068 A1 Feb. 9, 2023

Related U.S. Application Data

(60) Provisional application No. 63/230,023, filed on Aug. 5, 2021.

(51) Int. Cl.

| | |
|---|---|
| ***B65D 81/36*** | (2006.01) |
| ***A63H 33/00*** | (2006.01) |
| ***B65B 5/04*** | (2006.01) |
| ***B65B 7/06*** | (2006.01) |
| ***B65D 77/12*** | (2006.01) |

(52) U.S. Cl.

CPC ..... *B65D 81/365* (2013.01); *A63H 33/004* (2013.01); *B65B 5/045* (2013.01); *B65B 7/06* (2013.01); *B65D 77/12* (2013.01)

(58) Field of Classification Search

USPC ..... 53/73

See application file for complete search history.

(56) References Cited

U.S. PATENT DOCUMENTS

D358,054 S * 5/1995 Burdorf ..... A63H 3/003 D6/597

6,030,274 A * 2/2000 Kaplan ..... A63H 3/003 446/76

* cited by examiner

*Primary Examiner* — Chinyere J Rushing-Tucker

(74) *Attorney, Agent, or Firm* — H. Brock Kolls

(57) ABSTRACT

The present invention relates to a plush toy parcel, and particularly to a plush toy parcel that includes one or more parcel panels that are fabricated from one or more material sheets. The parcel panels are fastened together forming a pocket having a pocket opening along at least one edge, one or more inner panel surfaces, and one or more outer panel surfaces. One or more arms are part of the parcel panel and are positioned proximate to the pocket opening in a manner that tying the arms together closes the pocket opening. A postal indicia is inscribed or a label fastened to the inner panel surface, the postal indicia is only visible when the pocket is turned inside out. The postal indicia effectuates the shipping of the plush toy parcel.

18 Claims, 10 Drawing Sheets

PLUSH TOY PARCEL SUITABLE FOR SHIPPING

CROSS-REFERENCE TO RELATED APPLICATIONS

This application contains subject matter which is related to the subject matter of the following co-pending application. The below-listed application is hereby incorporated herein by reference in its entirety:

This is a U.S. non-provisional application that is a continuation in part of a U.S. non-provisional application, Ser. No. 63/230,023, inventor Cheyenne Marie Raker, entitled "PLUSH TOY PARCEL THAT IS TRANSFORMABLE INTO A POSTAL PACKAGE SUITABLE FOR SHIPPING TO A RECYCLING FACILITY", filed Aug. 5, 2021.

TECHNICAL FIELD OF THE INVENTION

This invention relates to plush toys, and particularly to child or pet toys that can be transformed into a postal package by turning it inside out making it suitable for shipping to a recycling center or other destination.

BACKGROUND OF THE INVENTION

Before our invention, little to no research has shown the reasoning as to why customers are constantly upset with the quality and value of their pet's toys. Large retail stores like PETSMART sell various pet items ranging from toys, bedding, bowls, carriers, collars, leashes, furniture, and more. Pet toys, however, are continuing to see steady growth. They are one of the faster-growing segments in the pet toy category. As an example, in 2016, pets accounted for 75% of pet toy sales, which passed $1B in the United States, up from $851 million in 2011.

It is common to find, online reviews of pet toys that are given an overall rating from 1-star to 5-stars based on three categories: quality, value, and pet satisfaction. Out of every review category, the most consistent and passionate 1-star rating is towards quality and durability.

After introducing the newly purchased item to their pet, customers state it had ripped or been chewed up and destroyed in a matter of days or even hours. Therefore, needing to discard the recent purchase and replace it with a new one. This constant cycle of customers needing to replace newly bought pet toys alludes to the possibility of planned obsolescence within the pet industry.

There is little existing research on the environmental impact of children's plush toy creation. These toys are a fundamental component of a children's development as traditional non-electronic imaginative play boosts spatial relations and mathematical learning. However, since children progress through developmental stages quickly, their preference for toys evolves as well. The evolution of their toys either becomes donated, passed down, or discarded into our landfills today. This rapid turnover leads to the suggestive use of more environmentally friendly alternatives or methods to minimize the impact of low longevity toys.

The present invention addresses these and other shortcomings by providing child and pet toys that are transformable into a postal package suitable for shipping to a recycling center or other destinations and has other advantages. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a plush toy parcel that is suitable for shipping. The plush toy parcel comprises one or more parcel panels that are fabricated from one or more material sheets. The parcel panels are fastened together forming a pocket. The pocket has a pocket opening along at least one edge, one or more inner panel surfaces, and one or more outer panel surfaces. One or more arms are part of the parcel panel and are positioned proximate to the pocket opening in a manner that tying the arm together closes the pocket opening. A postal indicia is inscribed or a label fastened to the inner panel surface. The postal indicia are only visible when the pocket is turned inside out. The postal indicia effectuates the shipping of the plush toy parcel.

Additional shortcomings of the prior art are overcome and additional advantages are provided through the provision of a method of using a plush toy parcel that is suitable for shipping. The method comprises the steps of untying, by way of a customer, one or more arms to open the pocket opening. One or more parcel panel is fabricated from a material sheet. The parcel panel is fastened together forming the pocket. The pocket has the pocket opening along at least one edge, one or more inner panel surfaces, and one or more outer panel surfaces. A flap comprises a fastener. The flap is attached to the inner panel surface proximate to the pocket opening. One or more arms is part of the parcel panel and is positioned proximate to the pocket opening in a manner that tying the arm together closes the pocket. A postal indicia is inscribed or a label fastened to the inner panel surface.

The method continues by turning the pocket inside out revealing the postal indicia. The postal indicia effectuates the shipping of the plush toy parcel. Tucking each of the arms into the pocket. And, transforming the plush toy parcel into a package suitable for shipping by pulling the flap over the pocket opening, sealing each of the arms inside the pocket by closing the pocket opening.

Additional shortcomings of the prior art are overcome and additional advantages are provided through the provision of a plush toy parcel suitable for shipping. The plush toy parcel comprises one or more parcel panel that is fabricated from one or more material sheet. The parcel panel is fastened together forming a pocket. The pocket has a pocket opening along at least one edge, one or more inner panel surfaces, and one or more outer panel surfaces. One or more arms is part of the parcel panel and is positioned proximate to the pocket opening in a manner that tying the arm together closes the pocket opening. A flap comprises a fastener. The flap is attached to the inner panel surface proximate to the pocket opening. When the pocket is turned inside out each of the arms is tucked inside the pocket. The flap is pulled over the pocket opening sealing the pocket closed by way of the fastener. And, a postal indicia is inscribed or a label fastened to the inner panel surface, the postal indicia is only visible when the pocket is turned inside out, the postal indicia effectuates shipping of the plush toy parcel.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The foregoing and other objects, features, and advantages of the invention are apparent from the following detailed description taken in conjunction with the accompanying drawings in which.

Figure 1A:
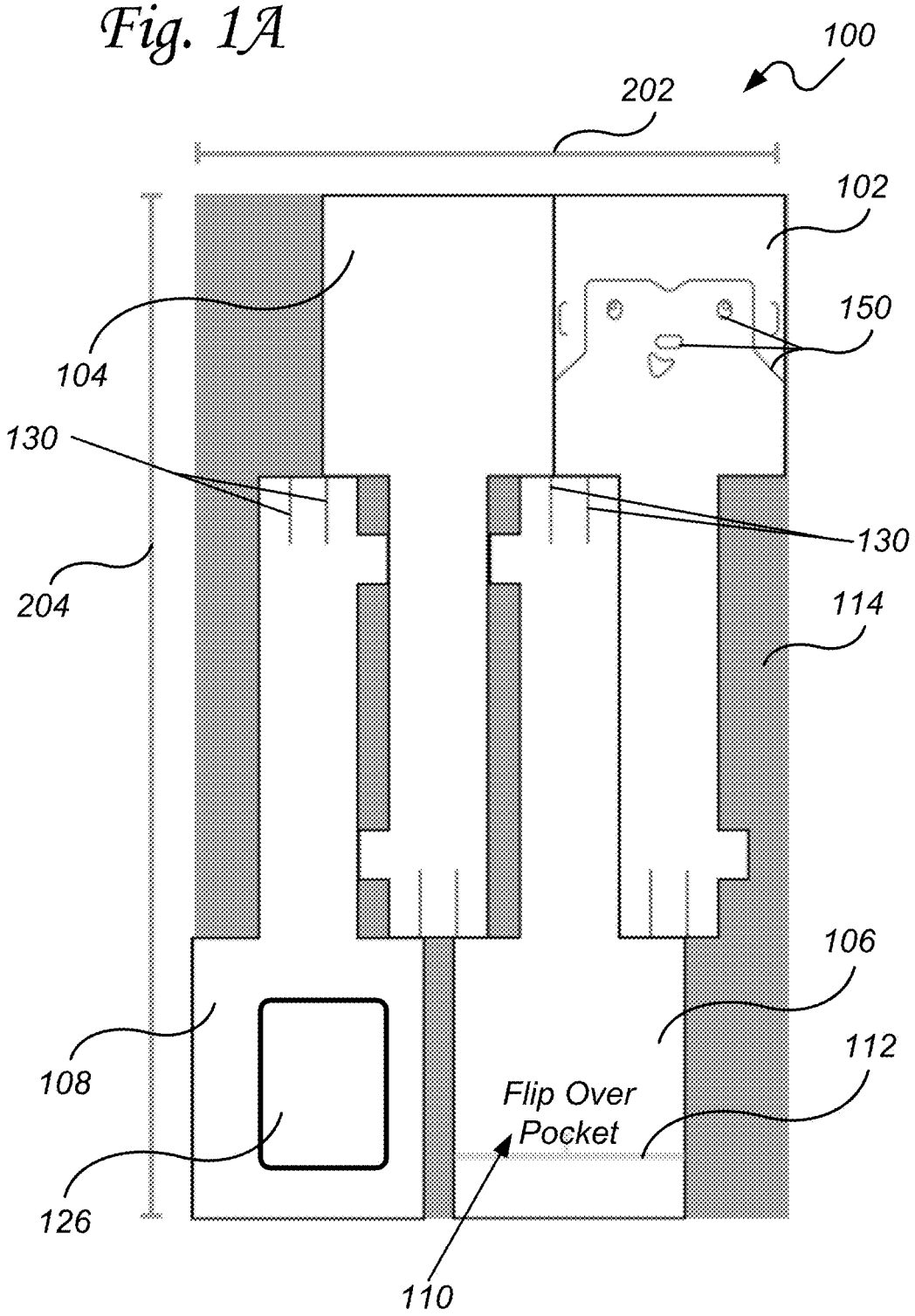
FIGS. 1A-B illustrate an example of templates used to cut out a plush toy parcel from a recyclable material sheet.

The detailed description explains the preferred embodiments of the invention, together with advantages and features, by way of example with reference to the drawings.

DETAILED DESCRIPTION OF THE INVENTION

Planned obsolescence (PO) is a strategy in industrial design to plan or design a product with a limited useful life, in essence, planning that it will become obsolete, unfashionable, or no longer functional after a certain period. The term was initially coined in the United States in the late 1920s based upon a business strategy of creating goods with a limited lifetime use. An extensive body of literature argues for the benefits of PO, the strategy of designing products with low durability to induce repeat purchases from the consumers and allow the firm to sell a larger volume at a lower price. On one side, consumers only see the benefit of decreased price, but when combined with a short life is the ideal scenario for businesses to exploit PO.

As an example and not a limitation, one such industry is the pet industry. Based upon pet industry leader websites, like PETSMART and PETCO, their toys can range anywhere in the price range between $0.79 to $200. The higher end is more technologically advanced, and the lower end is smaller, non-technical items, for example, tennis balls. On average, however, plush toy parcels typically fall in the $5 range. These are made from latex, rubber, soft fabrics, and a variety of other materials. Market research shows that customers are spending about $48 per year on toys alone, which is equivalent to about 10 toys per year that end up in our landfills. It may seem small, but with customer ownership continuing to rise, reaching 63.4 million in 2020, that number then becomes 634 million toys in our landfills each year. For purposes of disclosure, a pet can be a dog, a cat, or other kinds of animals.

As another example, and not a limitation, one such industry is the children's plush toy industry. In 2020, over $1 billion worth of plush toys were purchased alone. These toys play an essential role in children's development, however, most of these toys regretfully face a lonesome retirement once their owners grow up or move on. Since current toy design practices are not circular (as in reuse/recycle) and most toys are designed for short-term use, they will eventually be disposed of and end up in our landfills, in billions. Beginning in 1994, toys were designed under a planned obsolescence framework when Mattel began using a "rolling mix" where they would release slightly changed products over the course of the year to increase sales. Consistent new products resulted in consumers being more likely to buy and increased sales significantly. In addition, toys made without longevity in mind (weak materials, designed to break, fall apart, etc.) also play a part in the planned obsolescence of toys since it encourages the constant consumption and purchase of toys. Planned obsolescence is an unsustainable practice because when toys are designed with a short life span, their environmental impact will be higher since the impact is apportioned over the toy's lifetime. Recently, companies are now innovating ways to incorporate circular models and sustainability initiatives in the toy industry (take-back programs, subscription programs, etc.), but most of them do not involve plush toys. Therefore, there is a need to innovate for sustainability and recyclability in the plush toy industry.

In addition, planned obsolescence is not only in terms of the durability of plush toys, but can also be in the seasonality of it. In this regard, both the toy itself and when children "grow out of them". Certain toys can be made seasonally, for example, characters such as Santa and reindeer during the Christmas season. Businesses may have lots of leftover plush toy stock when the season passes that require discarding. An advantage, in the present invention, is that such seasonal and other similar types of plush toys instead of being dumped in a landfill can be flipped inside out to form a plush toy parcel suitable for shipping, to a textile recycling facility or another destination, without any additional packaging, promoting sustainability rather than waste.

Customers have come to accept what a 'normal' lifespan is for these items. PO has been indiscriminately practiced in the camouflaged form right up to the present day through these so-called durable products. Due to the high volume of negative product reviews of durability and having to throw away and replace their toys away within a few days, it seems that PO is evident. This strategy not only affects consumers and businesses but also affects the environment. Products with shorter lifespans produce more waste which in many circumstances ends up in landfills. PO is an unsustainable strategy because it is part of an unsustainable economic and development model and needs to be solved.

An advantage, of the present invention, is that the plush toy parcel can be flipped inside out to form a postal package so that the plush toy parcel can be sent to a textile recycling plant or other destination for recycling instead of a landfill. Another advantage of the present invention is that when a plush toy parcel is sent to the textile recycling plant or other destination, a new plush toy parcel can be sent to the customer and/or receive a discount on their next purchase. This business model ensures that the customer always has a new fresh plush character. Such business models can be subscription-based, loyalty, promotional, distributed at quick-serve restaurants, e-commerce based, retail, in-store, and other business models, as may be required and/or desired in a particular embodiment.

In this regard, the plush toy parcel, of the present invention, is a sustainable and plush toy parcel that can be returned to a textile recycling plant or other destination by the customer. In operation, in an exemplary embodiment, once customer 302 purchases the plush toy, they can stuff the toy with old garments, clothing, a child's blanket, or other items, and then take the plush toy parcel's 100 arms 122 and tie them together like a bag with two knots. The plush toy parcel 100 is then ready to be played with by a pet or child.

In another exemplary embodiment, customer 302 can receive in pocket 118 of the plush toy parcel 100 an identity kit 144/146 that allows customer 302 and/or child to decorate the outer surface 154. Additionally, there can be plush items 148 such as a book or other plush items placed in pocket 118.

In an exemplary embodiment, customer 302 can periodically receive a plush toy parcel having an identity kit 144/146, and/or a plush item 148. Such an identity kit 144/146, and/or a plush item 148 can be themed. As an example and not a limitation, cooking, gardening, doctors/nurses, police, firefighters, and other themes. The customer 302 and/or child can decorate the plush toy parcel 100 with the themed items in the identity kit 144/146. The identity kit 144/146 can comprise facial features (eyes, nose, lips, and other facial features), hair, and other features 144, costume features 146, and other features as may be required and/or desired in a particular embodiment. The plush item 148 can also be part of the theme such as a book that complements the theme. The plush items 148 can be, for example, and not a limitation, books, a compass, a magnifying glass, glasses, gardening items such as seeds, and a plurality of other items that support a plurality of different themes.

Once the child or pet loses interest in the toy or it becomes damaged, the customer 302 can then take the old clothing out (and squeakers 130 if present) and any of the identity kit 144/146, or plush items 148. When pocket 118 is empty, the plush toy parcel 100 can then be flipped inside out. The plush toy parcel 100 arms 122 formed by parcel panel 102/104 and 106/108 can then be tucked inside of pocket 118, and the flap 124 pulled over the pocket opening 140 of pocket 118, revealing postal indicia 126 which in an exemplary embodiment can be the business reply destination address and appropriate postage paid stamp or account information. Customer 302 can then place the old plush toy parcel 100 in the mailbox to be shipped to a textile recycling plant 152 or other destination where they will recycle the plush toy parcel 100 and selectively offer customer 302 an opportunity to request for free, buy at a discounted rate, trade, obtain through a subscription, purchase, or otherwise acquire a new plush toy parcel 100. In operation, when shipping, the plush toy parcel 100 can be placed directly in the mailbox without the need for any additional packaging. In this regard, in an exemplary embodiment, the plush toy parcel 100 when flipped inside out transforms into a parcel that is instantly ready to be shipped, no additional addressing, postage, or packaging necessary.

In an exemplary embodiment, an advantage in the present invention is that there is a convenient way to send the toy back to a textile recycling plant or other destination. Additionally, the long arm design of the plush toy parcel creates fun tug-of-war type interactions between the customer, pet, or child. When tied together at the ends, the arms 122 can double as a carry strap for a child. When configured as a pet toy, the pet toy can also include squeakers 130 and other noise-making devices to enhance the pet play experience. The squeakers 130 are illustrated in at least FIG. 2 on the arms 122, but in a plurality of other embodiments, the squeakers 130 can be located in other locations on the plush toy parcel 100.

Another advantage of the present invention is that it is a sustainable solution made from durable and recyclable materials. In addition, the present invention eliminates the polyfill stuffing material commonly found in prior art stuffed animals. Another advantage is that the present invention provides the ability to upcycle old clothing for use as soft fluffy fill material by stuffing the plush toy parcel with them, additionally providing a familiar scent of the pet's surroundings and/or owner which can decrease separation anxiety for the pet when left alone. In applications of the plush toy parcel 100 being used as a child's toy, an advantage in the present invention is that it provides the ability for the customer 302 or child to place objects such as blankets, clothing, and other objects to store and make soft the plush toy parcel 100.

The term "upcycle", "upcycling", "upcycle clothing", or "upcycle old clothing", in the present invention, is intended to mean old clothing that is more likely to be thrown away than worn again by the owner. In general, the upcycling concept, in a sustainability sense, is putting to good use something old, worn out, broken, or obsolete of little continued purpose or value rather than throwing it away. In an exemplary embodiment, upcycle clothing can be tee shirts, socks, rags, pants, hats, scarfs, jackets, underwear, and other clothing and fabrics, as may be required and/or desired in a particular embodiment.

The plush toy parcel encompasses concepts and ideas some of which include enabling the use of a prepaid business reply shipping label 126 inscribed on the inside fabric or as a label fastened to the inside fabric of the plush toy parcel 100 where customer 302 can flip it inside out to reveal the label 126 and place it in the mailbox at its end of life while still meeting all required postal dimensions of a business reply envelope or package.

In an exemplary embodiment, the plush toy parcel 100 can only be made from sustainable and durable materials such as polyethylene terephthalate (PET), recycled polyethylene terephthalate (rPET), and other sustainable and durable materials, but also ideally, made from materials that make recycling easier and eliminating the commonly used polyfill stuffing.

Turning now to the drawings in greater detail, it will be seen that in FIG. 1A there is illustrated one example of one or more templates used to cut out a plush toy parcel 100 from recyclable material 114. In an exemplary embodiment, templates can be placed on the recyclable material 114 and plush character parcel panels 102, 104, 106, and 108 can be cut out or otherwise fabricated. Plush toy parcel 100 can be made in a variety of different sizes of width 202 and length 204. In one exemplary embodiment, the size of the recyclable material 114 in which plush character parcel panels 102, 104, 106, and 108 are cut from can be preferably in the range of 18 inches in width 202 and 32 inches in length 204. In other exemplary embodiments, the range of width 202 and length 204 can be smaller or larger.

Figure 1B:
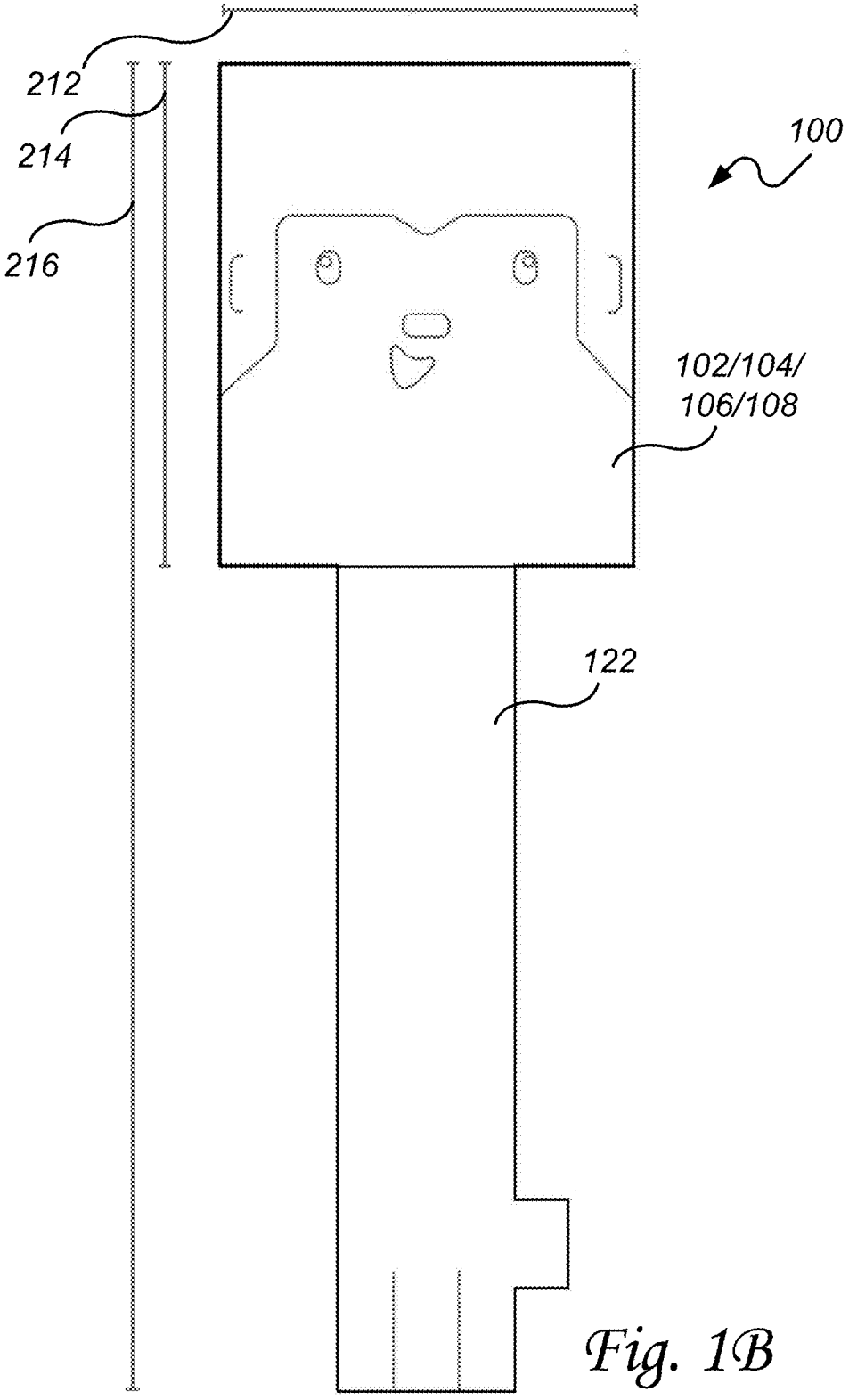

In an exemplary embodiment, and with reference to FIG. 1B, the size of the plush toy parcel 100 can be in the range of a parcel size formed by parcel panels 102/104/106/108 of 8 inches in width 212 and length 9.75 inches in length 214. In addition, arms 122 measured from the top of parcel 216 can be in the range of 25 inches. In a plurality of other exemplary embodiments, the width 212, height 214, and arm length 216 can be smaller or larger, as may be required and/or desired in a particular embodiment.

For purposes of disclosure, plush toy parcel 100 can also be referred to as the plush toy parcel 100, or plush toy parcel 100. Additionally, the plush toy parcel 100 can be manufactured from PET, rPET, materials that can be recycled, or other types and kinds of materials, as may be required and/or desired in a particular embodiment.

Details of a face or other pattern 150, hands 130, and other on plush character indicia referred to as caricature indicia 130/150 can be printed, sewn on, or otherwise added to the parcel panels 102/104/106/108, as may be required and or desired in a particular embodiment. In this regard, the caricature indicia 130/150 can be inscribed or sewn onto at least one of the outer panel surfaces 154.

In another exemplary embodiment, an identity kit 144/146 can be used to detail a face, body, arms, and other areas as may be required and/or desired in a particular embodiment.

Indicia 110, such as a 'Flip Over Here' or other indicia, and an indicia line 112 or other indicia reference marking can be added to the plush character part 106. Such indicia 110 can be informational providing customer 302 with instructions necessary in preparing the plush toy parcel 100 for shipping. In operation, such indicia markings inform customer 302 how to prepare the plush toy parcel 100 for shipment to the textile recycling plant 152 or other destination.

In this regard, postal indicia 126 can provide a shipping destination address, prepaid postage or account information, instructions, or other mailing markings or instructions that can be printed or otherwise inscribed or a label that can be fastened to the plush toy parcel 100 appearing on the pocket 118 inner panel surface 132 when assembled. As such, in operation, in an exemplary embodiment, the postal indicia 126 is only visible when the plush toy parcel 100 is flipped inside out exposing the inner panel surface 132.

In other embodiments, at least the instructions indicia for how to prepare the plush toy parcel 100 for shipping can be visible under other conditions including when the plush toy parcel 100 is not flipped inside out.

As illustrated in at least FIG. 1A, in an exemplary embodiment, as an example, and not a limitation, the parcel panels 102/104/106/108 can be shaped and sized to reduce the waste material sheet 114 when cut out or otherwise fabricated. In this regard, adopting pattern shapes and sizes that result in the parcel panels 102/104/106/108 being cut or otherwise fabricated from material sheet 114 with little to no waste material promotes one aspect of sustainability in the design of the present invention.

Figure 2:
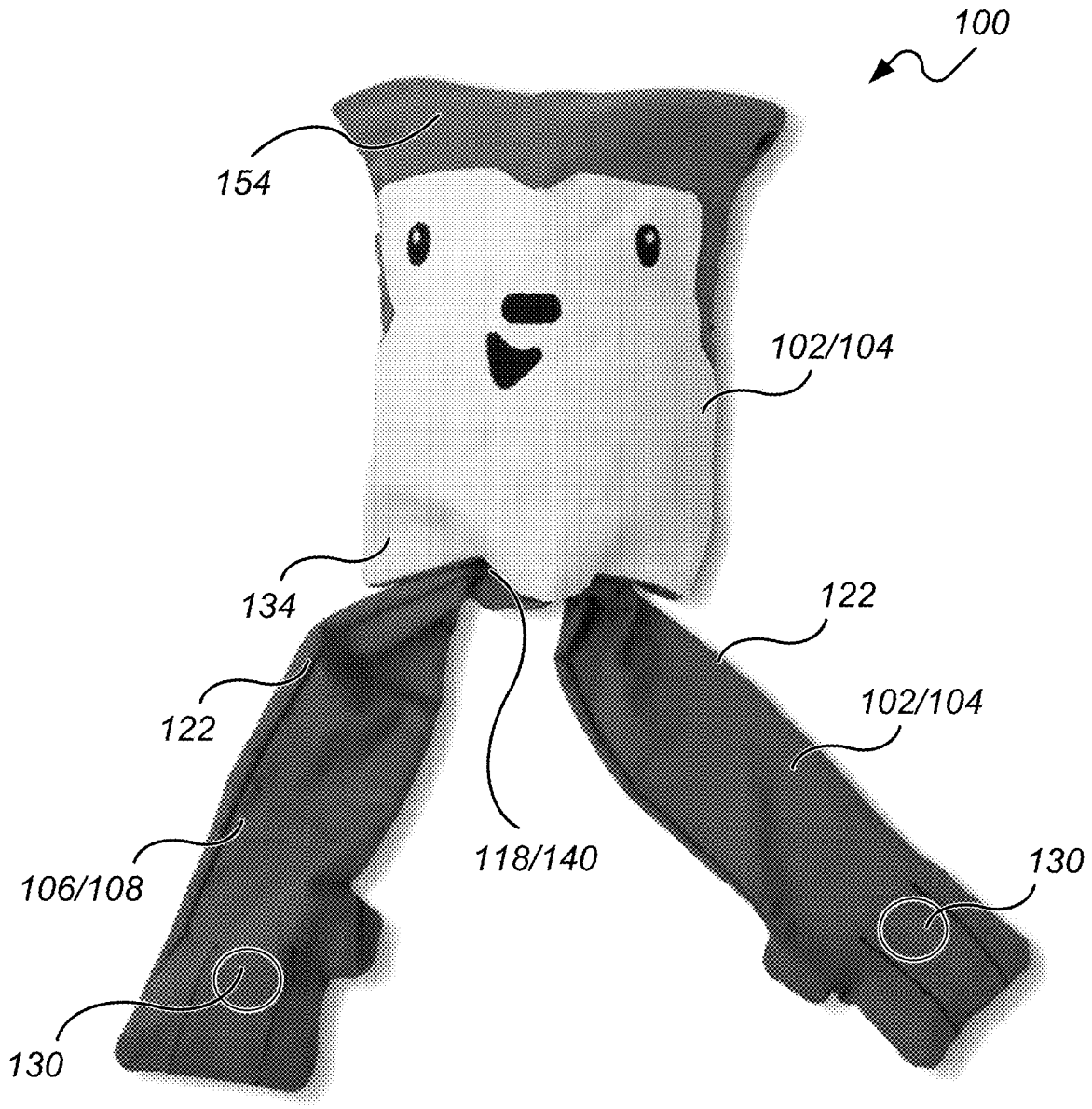
FIG. 2 illustrates one example of an assembled plush toy parcel.

Referring to FIG. 2 there is illustrated one example of an assembled plush toy parcel 100. In an exemplary embodiment, parcel panels 102 and 104 can be sewn together at the edges or otherwise fastened together to form one of the plush character arm 122. Parcel panels 106 and 108 can likewise be sewn together at the edges or otherwise fastened together to form the second plush character arm 122. The arm assemblies 122 can then be sewn at the edges 102/104 around the face/body portion 134 or otherwise fastened together forming a pocket 118 therebetween. Pocket 118 has a pocket opening 140 on at least one side. In this regard, one or more of an arm 122 can be fabricated from the material sheet 114. The arms 122 can be separately fastened or integrally formed with the face/body portion 134 proximate to the pocket opening 140 in a manner that tying the arms 122 together substantially closes the pocket opening 140 keeping items within the pocket 118 retained from falling out.

In an exemplary embodiment, a plush toy parcel 100 that is suitable for shipping in the postal system comprises one or more of a parcel panel 102/104/106/108 that can be fabricated from one or more of a material sheet 114. Each of the parcel panels 102/104/106/108 is fastened together forming a pocket 118. Pocket 118 has a pocket opening 140 along at least one edge, one or more of an inner panel surface 132, and one or more of an outer panel surface 154. One or more arm 122 can be part of the parcel panel 102/104/106/108 and is positioned proximate to the pocket opening 140 in a manner that tying the arms 122 together closes the pocket opening 140 preventing items in the pocket 118 from falling out. A postal indicia 126 is inscribed or a label fastened to the inner panel surface 132. The postal indicia 126 is only visible when pocket 118 is turned inside out. The postal indicia 126 effectuates the shipping of the plush toy parcel 100.

In an exemplary embodiment, the postal indicia is at least a destination address and a postage-paid stamp or account.

In another exemplary embodiment, a flap 124 comprises a fastener 128. The flap 124 is attached to the inner panel surface 132 proximate to the pocket opening 140. When pocket 118 is turned inside out. The flap 124 can be pulled over the pocket opening 140 sealing the pocket 118 closed, and held in place by way of the fastener 128.

Figure 3:
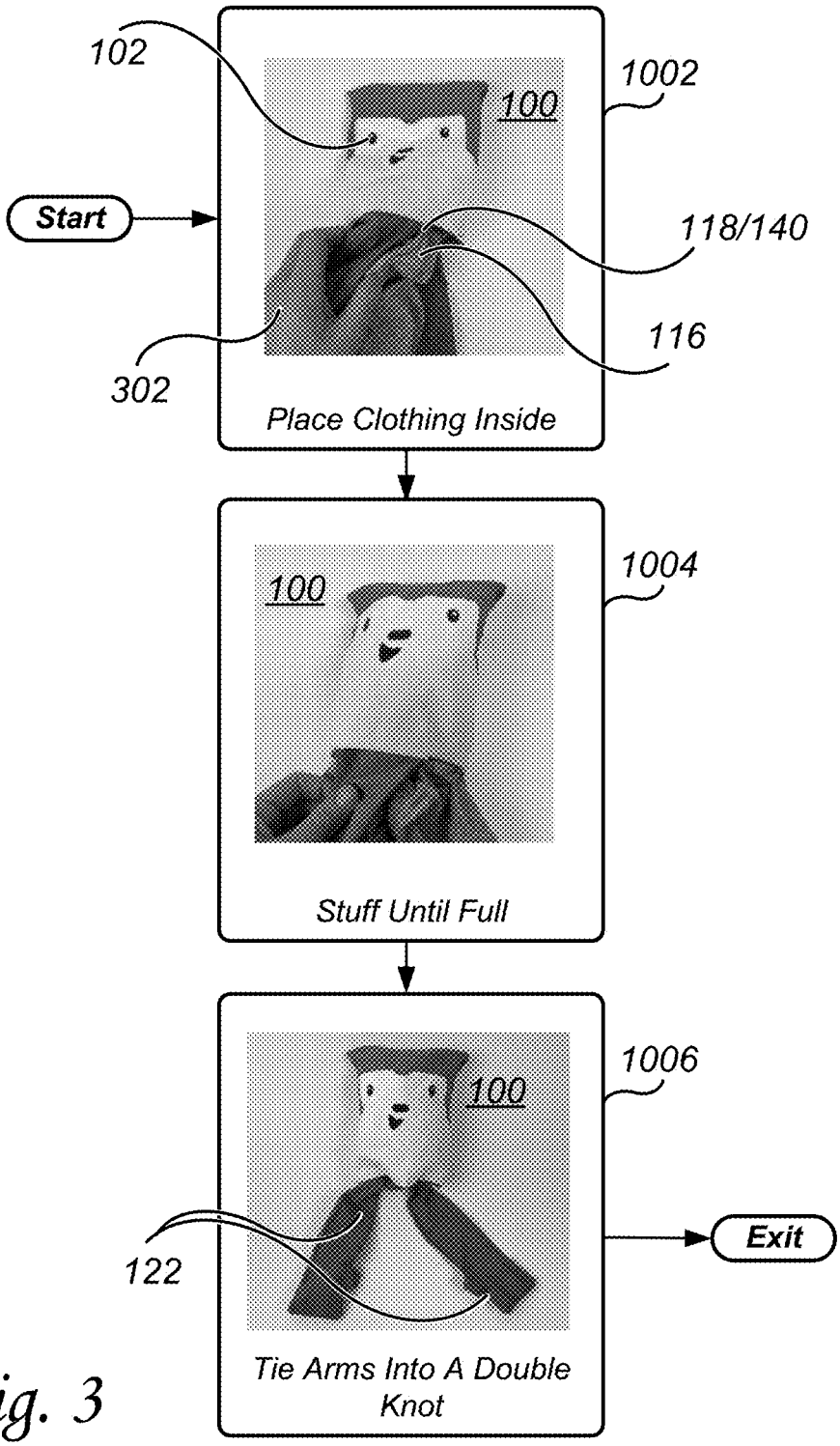
FIG. 3 illustrates one example of a method of stuffing a plush toy parcel.

Referring to FIG. 3, there is illustrated one example of a method of stuffing a plush toy parcel 100. In an exemplary embodiment, starting in step 1002, clothing 116 can be placed inside pocket 118 of the plush toy parcel 100 by customer 302. Such clothing can be a shirt, pants, blanket, scarf, hat, upcycle clothing, or other clothing, material, or other items, as may be required and/or desired in a particular embodiment. In addition, the method also includes a child playing with the plush toy parcel 100, opening and placing all types and kinds of objects in the plush toy parcel 100, pocket 118, and then using the arms 122 to secure those objects in the pocket by tying the pocket opening 140 closed with the arms 122, as may be required and/or desired in a particular embodiment.

Continuing in step 1004 the plush toy parcel 100 can be stuffed until full creating a soft pillow-like toy. Then in step 1006, the arms 122 can be tied in at least one knot, preferably two or more knots to secure the clothing inside pocket 118. The plush toy parcel 100 is then ready for use. In embodiments as a child's toy, the child can tie and untie the arms 122 to insert and remove items, even using the plush toy parcel 100 as a purse or other wearable fashion item. The method is then exited.

Figure 4:
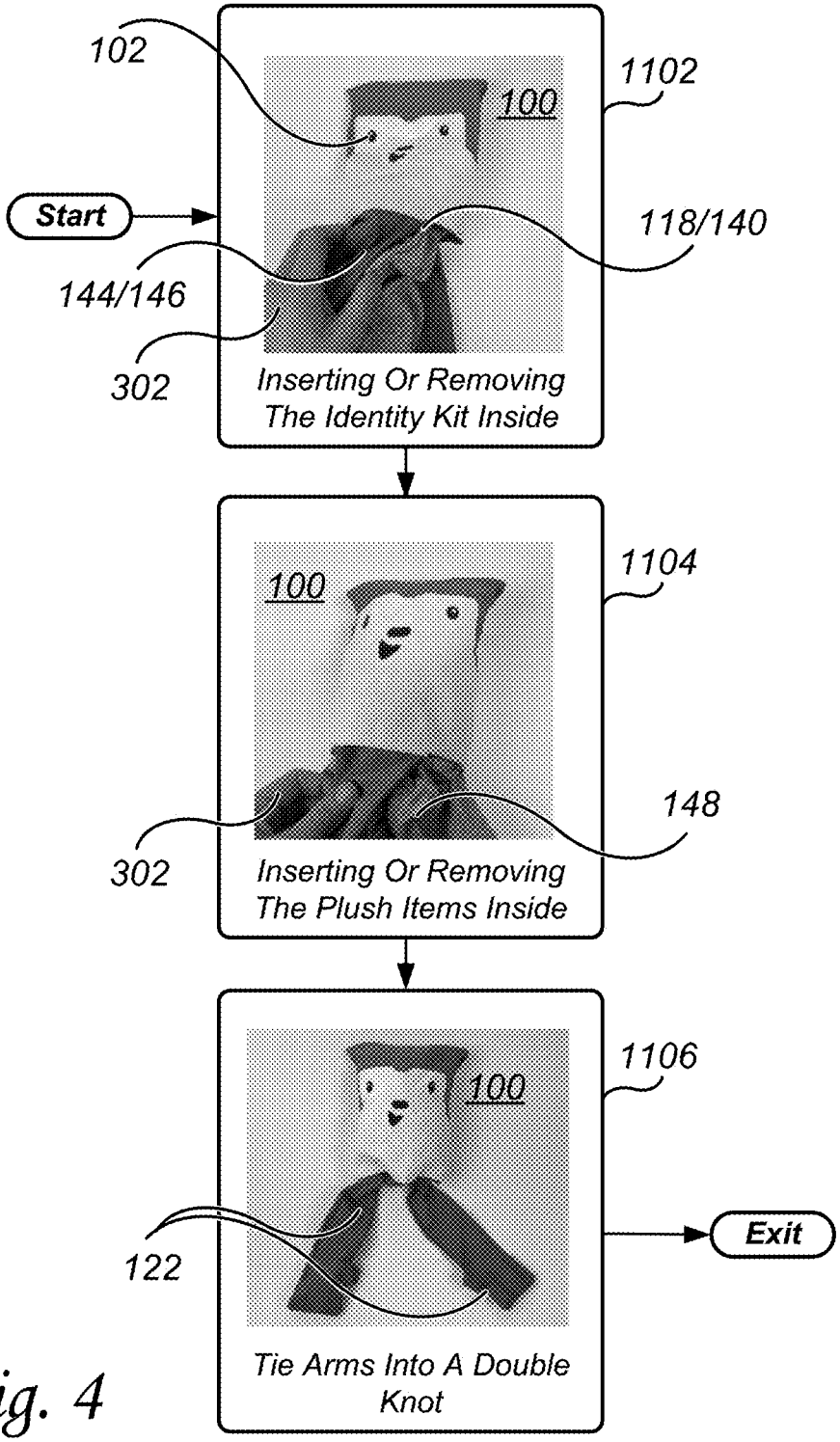
FIG. 4 illustrates one example of a method of inserting an identity kit and plush items in a plush toy parcel.

Referring to FIG. 4, there is illustrated one example of a method of inserting or removing the identity kit 144/146 and the plush items 148 in a plush toy parcel 100. In an exemplary embodiment, starting in step 1102, the identity kit facial features and body parts 144, costumes 146, and other items that are part of the identity kit 144 can be inserted into or removed from the plush toy parcel 100 pocket 118 by way of the pocket opening 140 by the customer 302 or child. In this regard, identity kit 144 can be used by customer 302 and/or children to decorate the plush toy parcel 100 in a permanent or temporary manner. In the case that the decoration is intended to be temporary, when done using the plush toy parcel 100 the identity kit 146 items can be removed and reinserted in pocket 118 for safe keeping until next time. Selectively, the arms 122 can be tied or untied to access the interior surface 132 of pocket 118 by way of the pocket opening 140. The method then moves to step 1104.

In step 1104, the plush items 148, and other items that are part of the identity kit 144 can be inserted into or removed from the plush toy parcel 100 pocket 118 by way of the pocket opening 140 by the customer 302. In this regard, plush items 148 that complement the themed identity kit 144/146 items can be removed, used, and restored in pocket 118. Such plush items 148 can be, for example, and not a limitation, books, a magnifying glass, glasses, gardening items such as seeds, and a plurality of other items that support a plurality of different themes. The method then moves to step 1106.

In step 1106, the arms 122 can be tied in at least one knot, preferably two or more knots to secure the clothing inside pocket 118. The plush toy parcel 100 is then ready for use. In embodiments as a child's toy, the child can tie and untie the arms 122 to insert and remove items, even using the plush toy parcel 100 as a purse or other wearable fashion item. The method is then exited.

Figure 5:
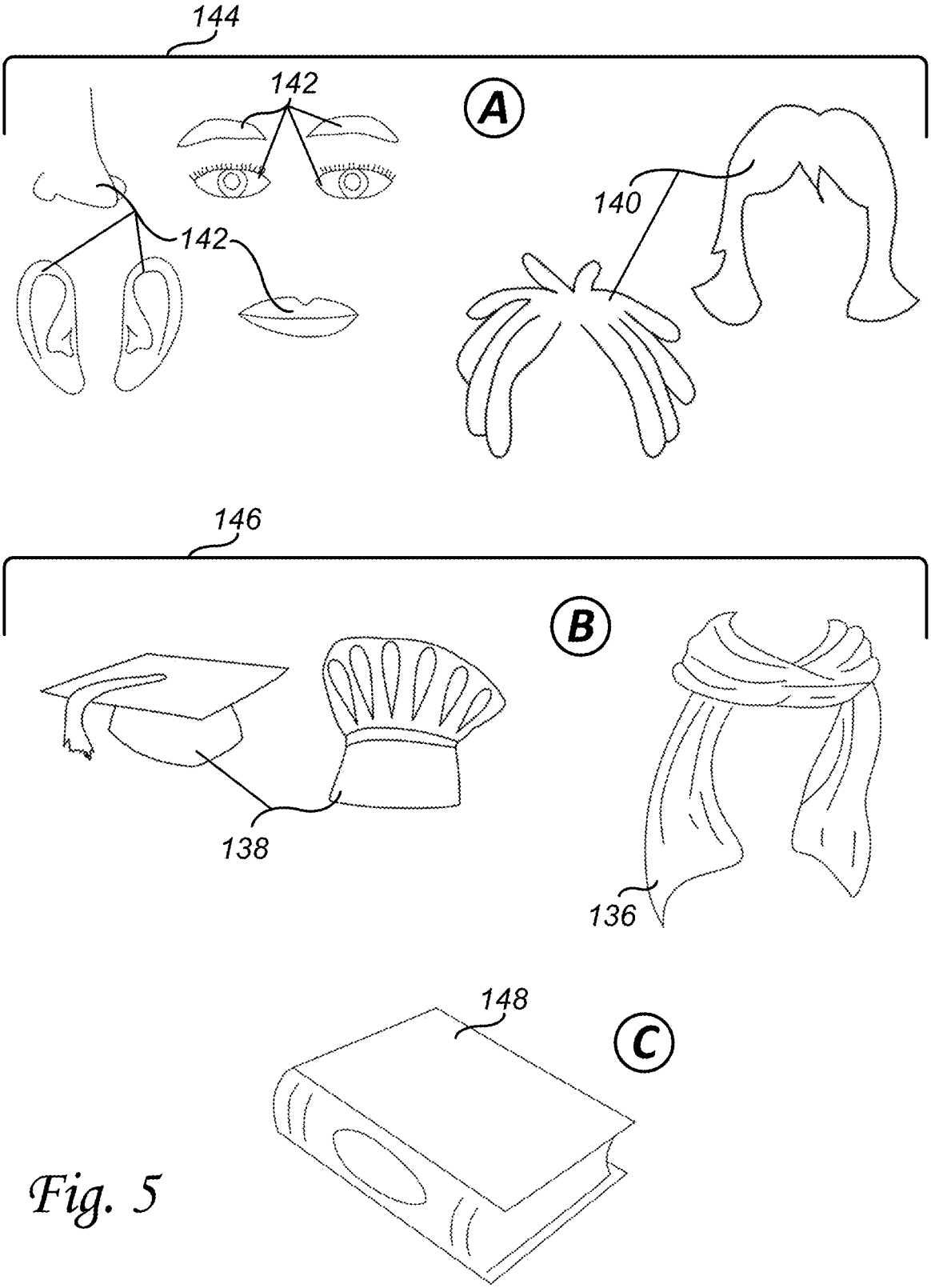
FIG. 5 illustrates one example of an identity kit and plush items.

Referring to FIG. 5, there is illustrated one example of an identity kit 144/146 and plush items 148. In an exemplary embodiment, the plush toy parcel 100 can be modified with items that can be placed on the outer panel surfaces 154. Such items can be part of an identity kit 144/146. In this regard, in reference 'A', facial features 144 can include face features 142 such as lips, eyes, ears, nose, eyebrows, other facial features, hair features 140, and other features that can be added as desired by the customer 302 to modify or otherwise customize the plush toy parcel 100. Additionally, in reference 'B', the costume features such as hats 138, scarfs 136, and other costume features can be as desired by customer 302.

In operation, the plush toy parcel 100 can include an identity kit 144/146 and plush items 148 that are themed. In this regard, themes can include cooking, gardening, doctors/nurses, police, firefighters, and other themes. The customer 302 and/or child can decorate the plush toy parcel 100 with the themed items in the identity kit 144/146.

In an exemplary embodiment, in reference 'C', can comprise plush items 148 such as a book or other plush items. The plush item 148 can also be part of the theme such as a book that complements the theme. The plus items 148 can be, for example, and not a limitation, books, a magnifying glass, glasses, gardening items such as seeds, and a plurality of other items that support a plurality of different themes.

Figure 6:
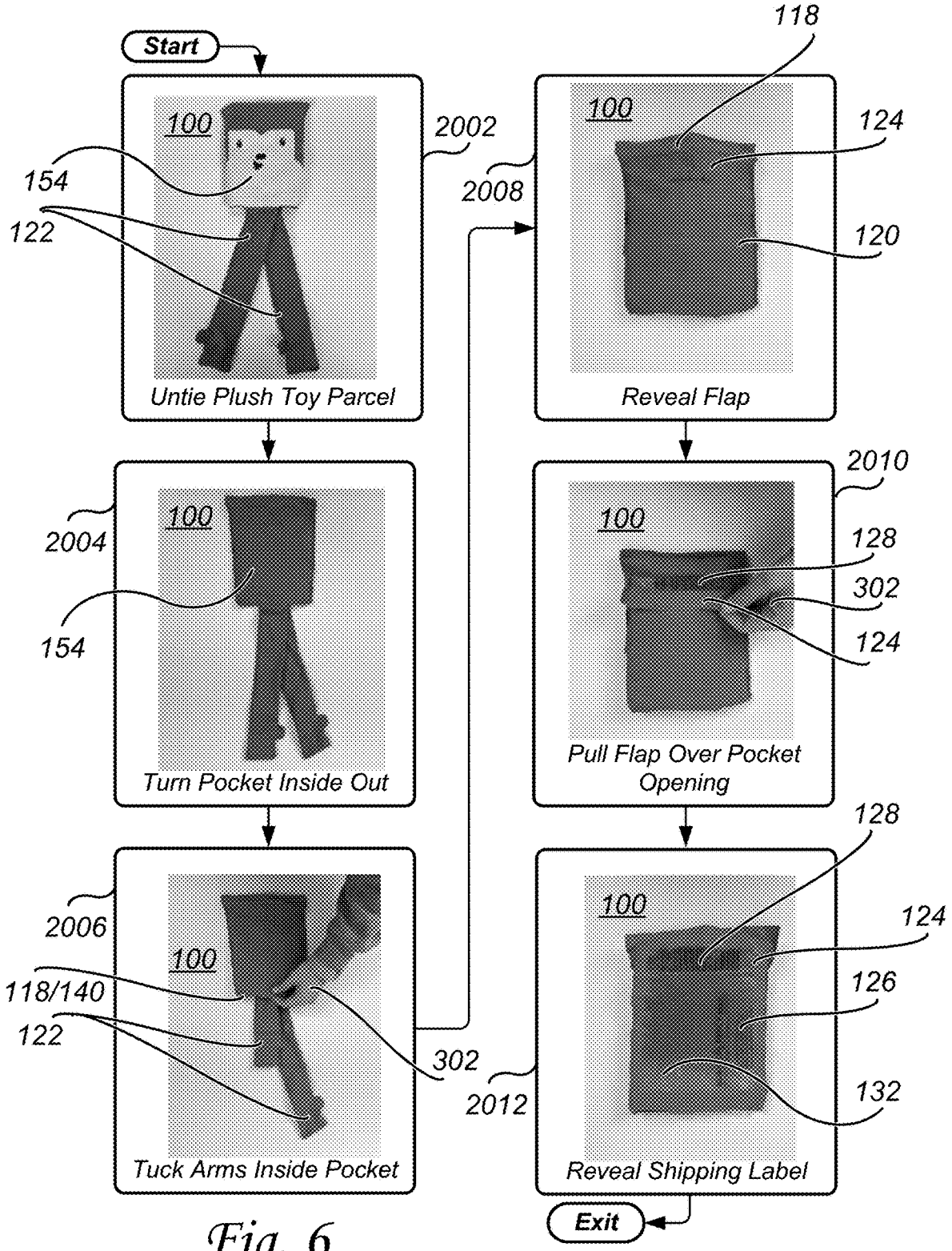
FIG. 6 illustrates one example of a method of transforming a plush toy parcel into a postal package shape.

Referring to FIG. 6, there is illustrated one example of a method of forming a plush toy parcel 100 into a postal package shape 120. In an exemplary embodiment, the method begins in step 2002 by untying the plush toy parcel 100 arms 122. In step 2004, the plush toy parcel 100 is then flipped inside out such that the inner surface 132 becomes the outside surface and in step 2006 the arms 122 are tucked inside pocket 118.

Once the arms 118 are tucked inside pocket 118, the method then continues in step 2008 by revealing the flapped 124 edges and fastener 128 proximate to pocket 118. As illustrated in at least FIG. 1A instructional indicia 110 and selectively an indicia reference line 112 can be included and viewable. The method moves to step 2010.

In step 2010 the flap 124 is pulled over the pocket opening 140 formed around the edge of the pocket 118 and fastener 128 such as hook-and-loop, buttons, snaps, or other fastener types seals pocket 118 with the arms 122 tucked inside forming a postal package shaped 120 plush toy parcel 100. In step 2012, once the plush toy parcel 100 is flipped inside out, the postal shipping indicia 126 is revealed. Such indicia can be the destination address, postage account to charge for shipping, postage stamp, and/or other indicia as may be required and/or desired in a particular embodiment.

Figure 7:
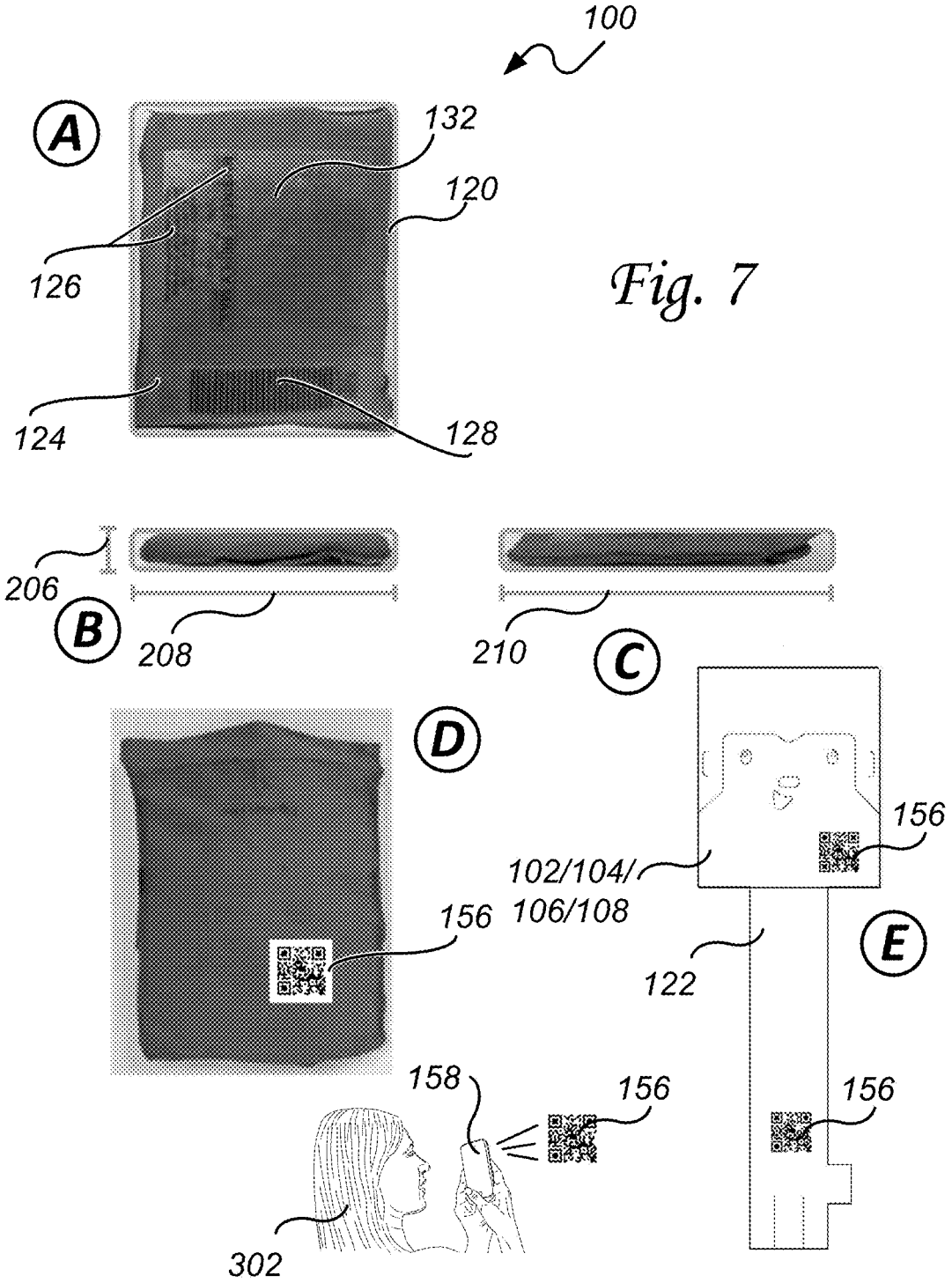
FIG. 7 illustrates one example of a plush toy parcel formed into a postal package shape ready for shipping.

Referring to FIG. 7, there is illustrated one example of a plush toy parcel 100 formed into a postal package shape 120 that is ready for shipping. Such a postal package shape 120 is formed by flipping the plush toy parcel 100 inside out and tucking the arms 122 inside the pocket 188. A flap 124 then closed the pocket opening 140 of the pocket 118 with a fastener 128 sealing the arms 122 inside. Fastener 128 can be snaps, hook-and-loop, buttons, snaps, or other fasteners, as may be required and/or desired in a particular embodiment.

In FIG. 7, reference 'A' is a top view inner panel surface 132 of the plush toy parcel 100 formed into postal package 120, reference 'B' is a front view of the plush toy parcel 100 formed into postal package 120, reference 'C' is a side of the plush toy parcel 100 formed into postal package 120, reference 'D' is a bottom side view outer panel surface 154 of the plush toy parcel 100, and reference 'E' illustrates the QR code being placed on the parcel panels 102/104/106/108 and arms 122 printed, inscribed, an attached label, or otherwise.

In an exemplary embodiment, QR code 156 can be placed on an inner panel surface 132, an outer panel surface 154 on the arms 122, on a label that is attached to the plush toy parcel, or other locations, as may be required and/or desired in a particular embodiment. In operation, QR code 156 can allow customer 302 to access website information and other QR code encoded data using a QR code reading digital device 158, such as a smartphone, tablet, or other digital devices. Such website information and other QR code encoded data can include, for example, and not a limitation, instructions, account information, and other types and kinds of links and encoded data, as may be required and/or desired in a particular embodiment.

While the formed postal package dimension of the plush toy parcel 100 can vary and can be selected based on the requirements of the shipping company, in one exemplary embodiment, for example, and not a limitation, the dimensions of the formed plush toy parcel 100 formed into a postal package 120 can be 7 inches in width 208, 8.5 inches in length 210, and 0.25 inches thick 206. In a plurality of other exemplary embodiments, the width 208, length 210, and/or thickness 206 can smaller or larger, as may be required and/or desired in a particular embodiment.

Figure 8:
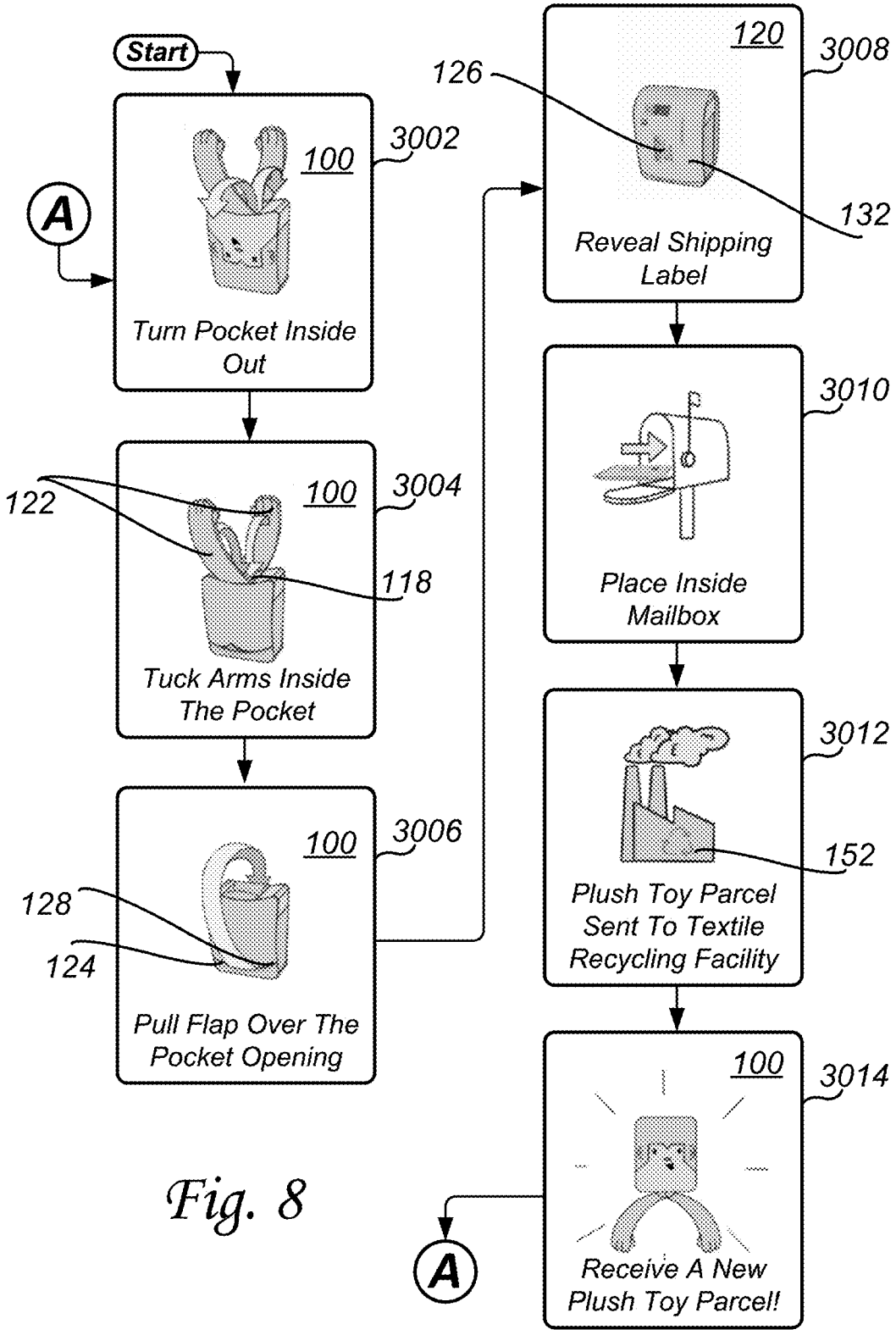
FIG. 8 illustrates one example of a method of recycling a plush toy parcel.

Referring to FIG. 8, there is illustrated one example of a method of recycling a plush toy parcel 100. In an exemplary embodiment, in step 3002 the plush toy parcel 100 can be flipped inside out, and in step 3004 the arms 122 can be tucked into pocket 118.

Continuing, in step 3006 the flap 124 can be pulled over the pocket 118 opening, and the pocket 118 fastened closed by fastener 128. In step 3010, the plush toy parcel 100 is transformed into a postal package 120 revealing postal indicia 126 which provides a shipping destination address, instructions, postage account or prepaid stamp, or other mailing markings or instructions. In step 3010, the formed postal package 120 can be placed in the mailbox for shipping, as is with no further packaging required. In this regard, the plush toy parcel 100, in step 3012, is sent to the textile recycling facility 152 or another destination.

In a plurality of business models, in step 3014, a new replacement plush toy parcel 100 can be returned or otherwise sent to customer 302. In this regard, customer 302 may get a free replacement plush toy parcel 100, buy the replacement toy 100, subscribe for a periodic fee to receive an additional or replacement plush toy parcel 100, or by way of another business model acquire an additional or new replacement plush toy parcel 100, as may be required and or desired in a particular embodiment. Said differently, through a business transaction, a prepaid arrangement, an e-commerce transaction, a sustainability program or campaign, or other business model or program an additional or a new plush toy parcel can be sent to the customer. The method then returns to step 3002.

Figure 9:
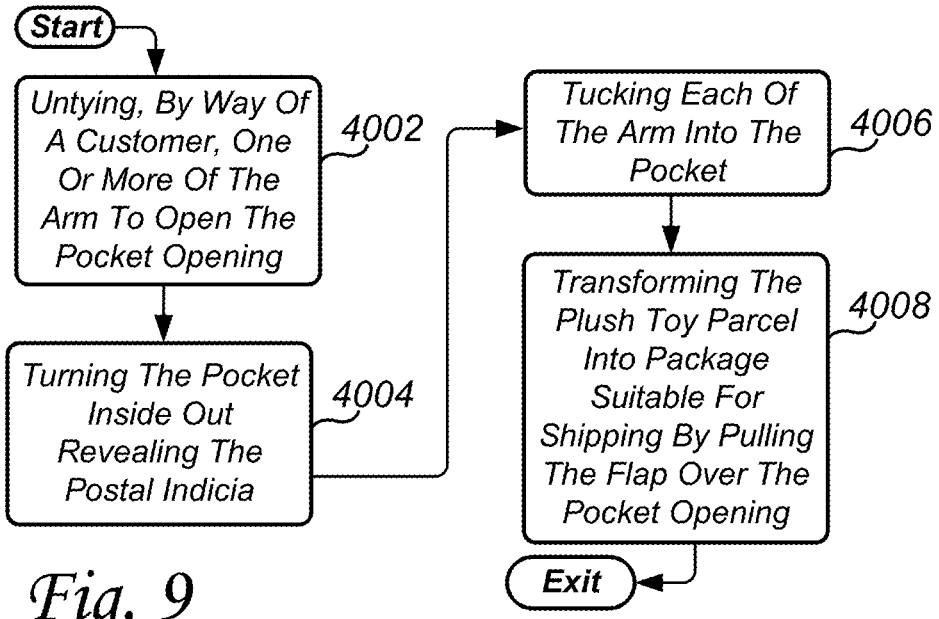
FIG. 9 illustrates one example of a method of using a plush toy parcel that is suitable for shipping.

Referring to FIG. 9, there is illustrated one example of a method of using a plush toy parcel 100 that is suitable for shipping. The method begins in step 4002 by untying, by way of a customer 302, one or more of the arm 122 to open the pocket opening 14. The plush toy parcel 100 comprises one or more of a parcel panel 102/104/106/108 and can be fabricated from a material sheet 114. The parcel panel is fastened together forming pocket 118. The pocket has the pocket opening 140 along at least one edge, one or more of an inner panel surface 132, and one or more of an outer panel surface 154. A flap 124 comprises a fastener 128. The flap 124 is attached to the inner panel surface 132 proximate to the pocket opening 140. One or more of the arm 122 is part of the parcel panel 102/104/106/108 and is positioned proximate to the pocket opening 140 in a manner that tying the arms 122 together closes the pocket 118. A postal indicia 126 is inscribed or a label fastened to the inner panel surface 132. The method then moves to step 4004.

In step 4004, the pocket is then turned inside out revealing the postal indicia 126. The postal indicia 126 effectuates shipping of the plush toy parcel 100. The method then moves to step 4006.

In step 4006, each of the arms 122 is tucked into pocket 118. The method then moves to step 4008.

In step 4008, the plush toy parcel 100 is transformed into a package 120 suitable for shipping by pulling the flap 124 over the pocket opening 140, sealing each of the arms 122 inside the pocket 118 by closing the pocket opening 140. The method is then exited.

Figure 10:
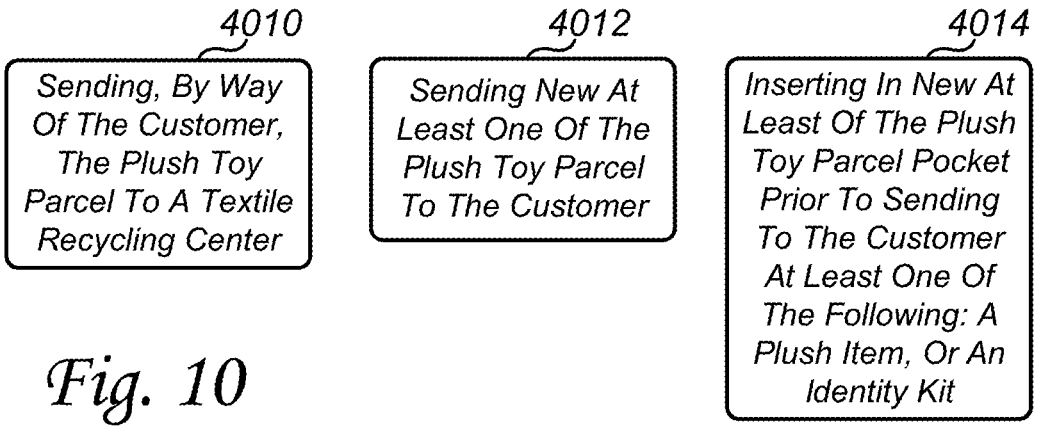
FIG. 10 illustrates exemplary embodiments of a method of using a plush toy parcel that can be interchangeably used with the methods of the present invention.

Referring to FIG. 10, there are illustrated exemplary embodiments of a method of using a plush toy parcel 100 that can be interchangeably used with the methods of the present invention.

In step 4010, the plush toy parcel 100 can be sent, by way of customer 302, to a textile recycling center 152 or other destination, wherein the plush toy parcel 100 is recycled.

In step 4012, a new at least one of the plush toy parcel 100 is sent to customer 302.

In step 4014, inserting, in a new at least one of the plush toy parcel 100, pocket 118 prior to sending to the customer 302 at least one of the following: a plush item 148, or an identity kit 144/146.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment of the invention has been described, it will be understood that those skilled in the art, both now and in the future, may make various improvements and enhancements.

What is claimed is:

1. A plush toy parcel suitable for shipping, the plush toy parcel comprising:

one or more parcel panel is fabricated from one or more material sheet, the one or more parcel panel is fastened together forming a pocket having a pocket opening along at least one edge, one or more inner panel surface, and one or more outer panel surface, the perimeter of the pocket forms the extent of the plush toy parcel and the pocket can be turned inside out to form a postal package that can be shipped absent additional external packaging;

one or more arm is part of the parcel panel and is positioned proximate to the pocket opening in a manner that tying the one or more arm together closes the pocket opening;

a flap comprises a fastener, the flap is attached to the inner panel surface proximate to the pocket opening, the flap is not viewable or useful until the pocket is turned inside out exposing the flap, the flap is pulled over the pocket opening, sealing the pocket closed by way of the fastener; and a postal indicia is inscribed or fashioned as a label fastened to the one or more inner panel surface, the postal indicia is only visible when the pocket is turned inside out, the postal indicia effectuates shipping of the plush toy parcel.

2. The plush toy parcel in accordance with claim 1, the postal indicia is at least a destination address and a postage-paid stamp.

3. The plush toy parcel in accordance with claim 1, a caricature indicia is inscribed or sewn onto at least one of the one or more outer panel surface.

4. The plush toy parcel in accordance with claim 1, further comprising:

an identity kit comprises at least one of the following for attachment by a customer to the one or more outer panel surface: one or more facial feature item, or one or more costume item.

5. The plush toy parcel in accordance with claim 1, at least one plush item is placed into the pocket, each of the one or more arm when tied together prevents the at least one plush item from egressing the pocket.

6. The plush toy parcel in accordance with claim 5, the at least one of the plush item is a book.

7. The plush toy parcel in accordance with claim 1, the one or more material sheet is recycled polyethylene terephthalate (rPET).

8. A method of using the plush toy parcel of claim 1, the method comprising the steps of:

untying, by way of a customer, the one or more arm to open the pocket opening;

turning the pocket inside out to reveal the postal indicia;

tucking each of the one or more arm into the pocket; and transforming the plush toy parcel into a package suitable for shipping by pulling the flap over the pocket opening, and sealing each of the one or more arm inside the pocket by closing the pocket opening.

9. The method in accordance with claim 8, further comprising the step of:

sending, by way of the customer, the plush toy parcel to a textile recycling center, wherein the plush toy parcel is recycled.

10. The method in accordance with claim 9, the step of sending the plush toy parcel to the textile recycling center further comprising the step of:

sending new at least one of the plush toy parcel to the customer.

11. The method in accordance with claim 10, the step of sending new at least one of the plush toy parcel to the customer further comprising the step of:

inserting, in new at least one of the plush toy parcel pocket, prior to sending to the customer at least one of the following: a plush item, or an identity kit.

12. The method in accordance with claim 11, the identity kit, for attachment by a customer to the one or more outer panel surface, comprises at least one of the following: one or more of a facial feature item, or one or more of a costume item.

13. The method in accordance with claim 11, the plush item is a book.

14. The method in accordance with claim 8, wherein the one or more material sheet is recycled polyethylene terephthalate (rPET).

15. A plush toy parcel suitable for shipping, the plush toy parcel comprising:

one or more parcel panel is fabricated from one or more material sheet, the parcel one or more panel is fastened together forming a pocket having a pocket opening along at least one edge, one or more inner panel surface, and one or more outer panel surface, the perimeter of the pocket forms the extent of the plush toy parcel and the pocket can be turned inside out to form a postal package that can be shipped absent additional external packaging;

one or more arm is part of the one or more parcel panel and is positioned proximate to the pocket opening in a manner that tying the one or more arm together closes the pocket opening;

a flap comprises a fastener, the flap is attached to the one or more inner panel surface proximate to the pocket opening, the flap is not viewable or useful until the pocket is turned inside out exposing the flap, then each of the one or more arm is tucked inside the pocket, and the flap is pulled over the pocket opening, sealing the pocket closed by way of the fastener;

at least one plush item is placed into the pocket, each of the one or more arm when tied together prevents the plush item from egressing the pocket; and a postal indicia is inscribed or fashioned as a label fastened to the one or more inner panel surface, the postal indicia is only visible when the pocket is turned inside out, the postal indicia effectuates shipping of the plush toy parcel.

16. The plush toy parcel in accordance with claim 15, the postal indicia is at least a destination address and a postage-paid stamp.

17. The plush toy parcel in accordance with claim 15, a caricature indicia is inscribed or sewn onto at least one of the one or more outer panel surface.

18. The plush toy parcel in accordance with claim 15, further comprising:

an identity kit, for attachment by a customer to the one or more outer panel surface, comprises at least one of the following: one or more facial feature item, or one or more costume item.

* * * * *